United States Patent [19]

Feldman et al.

[11] Patent Number: 4,634,550

[45] Date of Patent: Jan. 6, 1987

[54] POUR DEPRESSANT

[75] Inventors: Nicholas Feldman, Woodbridge; John W. Frankenfeld, Atlantic Highlands, both of N.J.

[73] Assignee: Exxon Research and Engineering Company, Florham Park, N.J.

[21] Appl. No.: 785,241

[22] Filed: Oct. 7, 1985

[51] Int. Cl.[4] ..... C10M 107/20

[52] U.S. Cl. ..... 252/56 D; 252/56 R

[58] Field of Search ..... 252/56 D, 56 R; 208/96, 208/14; 44/70

[56] References Cited

U.S. PATENT DOCUMENTS

| | | | |
|---|---|---|---|
| 2,825,717 | 3/1958 | Cashman et al. | 252/56 D |
| 2,936,300 | 5/1960 | Tutwiler | 252/56 D |
| 3,532,618 | 10/1970 | Wunderlich | 208/96 |
| 3,814,690 | 6/1974 | Song | 252/56 D |
| 3,981,850 | 9/1976 | Wisotsky et al. | 252/56 D |
| 4,074,978 | 2/1978 | Panzer | 44/70 |
| 4,201,658 | 5/1980 | Jensen | 208/14 |
| 4,514,314 | 4/1985 | Rossi | 252/56 D |

*Primary Examiner*—William R. Dixon, Jr.
*Assistant Examiner*—Ellen McAvoy
*Attorney, Agent, or Firm*—Edward H. Mazer

[57] ABSTRACT

A pour depressant for hydrocarbon oils, such as hydrotreated shale oil, and a method for depressing the pour point of hydrocarbon oil utilizing the pour depressant are disclosed. The depressant comprises the combination of:

I. an asphaltenic material with copolymers of:
II. dibehenyl fumarate vinyl acetate; and,
III. ditallow fumarate vinyl acetate.

8 Claims, No Drawings

POUR DEPRESSANT

BACKGROUND OF THE INVENTION

This invention relates to improving the flow properties of wax-containing hydrocarbons. More particularly the present invention relates to pour depressants having utility in depressing hydrocarbon pour points where the hydrocarbon contains relatively high concentrations of paraffinic compounds, such as hydrotreated shale oil.

It is well known that petroleum oils often contain wax which will separate if the oil is cooled down below a certain temperature. As the temperature is lowered, the concentration of solid material increases, developing a gel caused by the formation of a coherent three dimensional network of wax crystals. As a result of this crystal structure, large amounts of oil are entrained in the crystal lattice of wax, thereby preventing the flow of the oil. The problem of wax formation is particularly significant in the treatment of highly paraffinic fuels, such as those derived from shale oil. Shale oil typically is hydrotreated to improve its generally poor storage stability. However, hydrotreating shale oil has been found to increase the wax or n-paraffin content of the shale oil from an already relatively high level. This results in a requirement that the hydrotreated shale oil be heated and kept above its pour point to avoid wax formation prior to and during processing. This further requirement increases the cost of transporting, storing and processing the shale oil.

The lowest temperature at which the oil will still flow is generally known as the pour point. When the fuel temperature goes below the pour point and the fuel is no longer free flowable, difficulty arises in transporting the fuel through flow lines and pumps, as for example, when attempting to transfer the fuel through pipelines.

This problem has been well recognized in the past and various additives have been suggested for depressing the pour point of oil. One function of such pour point depressants has been to change the nature of the crystals that precipitate from the oil, thereby reducing the tendency of the wax crystals to interlock and set into a gel.

U.S. Pat. No. 4,074,978 discloses the use of short chain unsaturated esters such as vinyl acetate, which can be copolymerized with long chain unsaturated esters such as dibehenyl fumarate. The copolymer may be admixed with asphaltenic material to produce a pour depressant having particular utility in depressing the pour point of atmospheric residuum and vacuum residuum. In Example I, the patentee discloses a series of tests in which a copolymer of behenyl fumarate and vinyl acetate are used in combination with an asphaltene to depress the pour point of the sample tested by 30°–40° F.

U.S. Pat. No. 3,532,618 discloses the use of asphaltenes from shale oil to depress the pour point of the shale oil.

U.S. Pat. No. 4,201,658 discloses the use of asphaltenic material for depressing the pour point of shale oil.

While each of the above-noted patents and publications discloses additives for reducing the pour point of hydrocarbons, such as shale oil, none of the publications discloses additives which permit the reduction of the pour point of the shale oil to a sufficiently low level to permit the shale oil, particularly hydrotreated shale oil, to be transported through pipelines without the use of an excessively large amount of pour depressant.

Accordingly, it would be desirable to provide a pour depressant which effectively reduces the pour point of oils having high wax contents by the addition of only relatively small quantities of additives.

It also would be desirable to provide a pour depressant which is relatively inexpensive.

It also is advantageous to employ a pour depressant which does not adversely affect the combustion properties of the resulting products.

The present invention is directed at a pour point depressant for a hydrocarbon comprising:

A. an asphaltene;

B. a copolymer of dibehenyl fumarate and vinyl acetate; and,

C. a copolymer of tallow fumarate and vinyl acetate.

SUMMARY OF THE INVENTION

The present invention is directed at a pour point depressant for a hydrocarbon oil comprising:

A. an asphaltene;

B. a copolymer of dibehenyl fumarate and vinyl acetate; and,

C. a copolymer of tallow fumarate and vinyl acetate.

The present invention also is directed at a method for depressing the pour point of hydrocarbons, especially those having a pour point of above about 40° F., particularly above about 50° F., comprising admixing with the hydrocarbon an effective amount of a pour depressant comprising:

A. an asphaltene;

B. a copolymer of dibehenyl fumarate and vinyl acetate; and,

C. a copolymer or ditallow fumarate and vinyl acetate.

The copolymer of dibehenyl fumarate and vinyl acetate, preferably comprises a copolymer having a molar ratio of dibehenyl fumarate to vinyl acetate, by weight, ranging between about 0.5:1 and about 1.5:1.

The copolymer of ditallow fumarate and vinyl acetate, preferably comprises a copolymer having a molar ratio of tallow fumarate to vinyl acetate, ranging between about 0.5:1 and about 1.5:1.

The asphaltene preferably comprises pure asphaltenes or a variety of refinery streams containing asphaltenes such as tars, asphalts, including lube deasphalting unit asphalts, or residuum vacuum bottoms.

The pour point depressant preferably also comprises a diluent, such as heavy aromatic naphtha or solvent 150 neutral.

The ratio of the weight of the asphaltene to the total weight of the copolymers ranges between about 0.5:1 and about 25:1.

In a preferred process for treating shale oil, the shale oil is hydrotreated prior to the addition of the pour depressant.

The pour point depressant preferably comprises between about 0.02 and about 3.0 wt. % of the hydrotreated shale oil.

DETAILED DESCRIPTION OF THE INVENTION

The hydrocarbon oils to which the present invention is applicable comprise wax containing oils such as shale oil, petroleum, tar sands oil, and mixtures thereof. The hydrocarbon oils for which the present invention is most applicable comprise oils having a pour point above at least about 40° F., particularly those oils having a pour point above 50° F. A hydrocarbon oil for which the present invention is of particular utility is shale oil, which, after hydrotreating, typically has a pour point of about 30° F. to about 100° F. Other hydrocarbon oils for which the present invention also may be particularly applicable include petroleum and tar sands liquids.

The present invention is directed at a pour point depressant comprising:

A. an asphaltene;

B. a copolymer comprising dibehenyl fumarate and vinyl acetate; and

C. a copolymer comprising ditallow fumarate and vinyl acetate.

A detailed description of each of these additives is described below:

A. Asphaltenes

Asphaltenes are known to the art as the highly aromatic, high molecular weight constituents contained in many crude petroleum residua and natural asphalts, particularly those known as asphalt-bearing residua. Typical properties of these materials are known in the art e.g., U.S. Pat. No. 3,093,573. Asphaltenes are generally solid, insoluble in alkanes, and can be isolated by contacting an asphalt-bearing residuum with a solvent-precipitant, normally a liquid paraffin having 5 to 9 carbon atoms, preferably n-heptane, in a ratio by volume of generally at least 4 parts of solvent-precipitant per part of residuum. The precipitant causes the asphaltene fraction to precipitate out as a solid material which can be subsequently removed by filtration, centrifugation, etc. A detailed description of one method of recovering asphaltenes is given in U.S. Pat. No. 3,087,887. Asphaltenes prepared in this manner are usually characterized by the substantial lack of any petrolene, e.g., aliphatic hydrocarbon soluble, component.

Asphaltenes suitable for use in this invention will usually have softening points, according to ASTM D-36-70, above about 350° F., preferably above about 450° F., or capillary tube melting points above about 300° F., preferably above about 400° F.

It is also possible to utilize asphaltene-containing refinery streams in the present invention. Such refinery streams may be asphalts, tars and certain residual oils themselves, such as Amuay heavy fuel oil, certain residuum vacuum bottoms, i.e., the portion boiling above about 1100° F., Tiajuana medium residua, Venezuelan residua, etc., such as LM Tar, etc. Such asphaltene-containing refinery streams will frequently contain from 5 to 25 weight percent asphaltenes based on the total weight of the stream and can be blended directly with the fuel oil to give the desired asphaltene content to the fuel.

B. Copolymer of dibehenyl fumarate and vinyl acetate

The dibehebnyl fumarate unsaturated esters may be prepared by reacting behenyl alcohol with fumaric acid by methods well-known in the art. The vinyl acetate can be co-polymerized with the dibehenyl fumarate. A method for the preparation of this copolymer is set forth in U.S. Pat. No. 4,074,978, the disclosure of which is incorporated herein by reference. The polymerization reaction may be carried out without diluent or in a solution of a hydrocarbon solvent such as heptane, benzene, cyclohexane or white oil, at a temperature in the range of from 60° to 250° F. and may be promoted by a peroxide type catalyst such as benzoyl peroxide, a hydroperoxide or an azo catalyst such as alpha-alpha'-azo-bis-isobutyronitrile. It is generally preferred to carry out the polymerization reaction under a blanket of an inert gas such as nitrogen or carbon dioxide in order to exclude oxygen. The polymerization time may vary from 1 to 36 hours.

C. Copolymer of ditallow fumarate and vinyl acetate

The ditallow fumarate unsaturated esters are prepared by reacting tallow alcohols with fumaric acid by methods well known in the art. The vinyl acetate can be copolymerized with the ditallow fumarate. The general method for the preparation of his type copolymer also is set forth in U.S. Pat. No. 4,074,978 and is similar to that previously described for the preparation of the copolymer of dibehenyl fumarate and vinyl acetate.

The following Comparative Examples and Example demonstrate the synergistic combination of the asphaltene, and the copolymers previously described in depressing the pour point of a hydrocarbon oil.

COMPARATIVE EXAMPLE I

The shale oil used in these tests was from the Rundle deposit in Australia processed by the Tosco II process. This shale oil hereinafter will be referred to as Rundle/-Tosco shale oil. The pour points of raw and hydrotreated Rundle/Tosco shale oil was determined by ASTM test method D-97, the disclosure of which is incorporated herein by reference. The pour point of the raw oil which had been filtered was 85° F., while the pour point of the hydrotreated, stabilized and dearsenated shale oil was 80° F.

COMPARATIVE EXAMPLE II

Approximately 2.5 wt.% of an asphalt stream from a lube deasphalting unit (LDU) comprising approximately 10 wt.% asphaltenes was added to the raw and to the hydrotreated shale oil, resulting in pour points of 85° F. and 85° F., respectively.

COMPARATIVE EXAMPLE III

A 1:1 molar ratio of a copolymer of dibehenyl fumarate and vinyl acetate was prepared. A 1:1 molar ratio of a copolymer of ditallow fumarate and vinyl acetate also was prepared.

Approximately 0.125 wt.% of a 1:1 molar ratio of a copolymer of dibehenyl fumarate and vinyl acetate, and 0.125 wt.% of a copolymer of a 1:1 ratio of ditallow fumarate and vinyl acetate were added to hydrotreated shale oil resulting in a pour point of 55° F.

COMPARATIVE EXAMPLE IV

Approximately 0.05 wt.% total of a 1:1 molar ratio of a copolymer of ditallow fumarate and vinyl acetate and 0.2 wt.% asphaltenes were added to the raw and to the hydrotreated shale oil of Comparative Example I, resulting in pour points of 55° F. and 75° F., respectively.

COMPARATIVE EXAMPLE V

Approximately 0.05 wt.% of a 1:1 molar ratio of a copolymer of dibehenyl fumarate and vinyl acetate and 0.2 wt.% asphaltenes were added to the raw and to the hydrotreated shale oil of Comparative Example I, resulting in pour points of 60° F. and 65° F., respectively.

COMPARATIVE EXAMPLE VI

Approximately 0.2 wt.% of a 1:1 molar ratio of a copolymer of dibehenyl fumarate and vinyl acetate was added to the raw and hydrotreated shale oil of Comparative Example I resulting in pour points of 60° F. and 60° F., respectively.

COMPARATIVE EXAMPLE VII

Approximately 0.2 wt.% of a 1:1 molar ratio of a copolymer of ditallow fumarate and vinyl acetate were added to the raw and hydrotreated shale oil of Comparative Example I resulting in pour points of 35° F. and 55° F., respectively.

EXAMPLE I

Approximately 0.025 wt.% of a 1:1 molar ratio of a copolymer of dibehenyl fumarate and vinyl acetate, 0.025 wt.% of a 1:1 molar ratio of a copolymer of tallow fumarate and vinyl acetate and 0.2 wt.% asphaltenes were added to the raw and hydrotreated shale oil of Comparative Example I, resulting in pour points of 25° F. and 35° F., respectively.

The results of Comparative Examples I—VII and Example I are summarized in Table I.

TABLE I

POUR POINT DEPRESSION BY USE OF ADDITIVES

| Reference | Additive | Wt. % | Total Wt. % | Pour Point, °F. Raw Oil | Hydrotreated Oil, °F. |
|---|---|---|---|---|---|
| Comp. e.g. I | None | — | — | 85 | 80 |
| Comp. e.g. II | LDU Asphaltene | 0.25 | 0.25 | 85 | 85 |
| Comp. e.g. III | Copolymer of dibehenyl fumarate and vinyl acetate; | 0.125 | 0.25 | — | 55 |
| | and Copolymer of ditallow fumarate and vinyl acetate | 0.125 | | | |
| Comp. e.g. IV | Copolymer of ditallow fumarate and vinyl acetate | 0.05 | 0.25 | 55 | 75 |
| | Asphaltene | 0.20 | | | |
| Comp. e.g. V | Copolymer of dibehenyl fumarate and vinyl acetate | 0.05 | 0.25 | 60 | 65 |
| | Asphaltene | 0.20 | | | |
| Comp. e.g. VI | Copolymer of dibehenyl fumarate and vinyl acetate | 0.20 | 0.20 | 60 | 60 |
| Comp. e.g. VII | Copolymer of ditallow fumarate and vinyl acetate | 0.20 | 0.20 | 35 | 55 |
| e.g. I | Copolymer of dibehenyl fumarate and vinyl acetate | 0.025 | | | |
| | Copolymer of tallow fumarate and vinyl acetate | 0.025 | 0.25 | 25 | 35 |
| | Asphaltene | 0.20 | | | |

Based on the results of Table I, it can be seen that the addition to a wax-containing hydrotreated shale oil of all three components set forth in Example I produced an oil having a significantly lower pour point than any combination of only two of the additives. Since the pour point test has an accuracy of about ±5° F. both the raw shale oil and the hydrotreated shale oil would meet the ±30° F. pour point specification for transporting the shale oil via pipelines.

The pour point depressant of the present invention may have the following composition based upon the hydrocarbon oil.

| Additive | Wt % Range | Preferred Wt % Range |
|---|---|---|
| Asphaltene | 0.01–2.0 | 0.05–0.5 |
| Copolymer of dibehenyl fumarate | 0.005–0.5 | 0.01–0.15 |

-continued

| Additive | Wt % Range | Preferred Wt % Range |
|---|---|---|
| and vinyl acetate | | |
| Copolymer ditallow fumarate and vinyl acetate | 0.005–0.5 | 0.01–0.15 |

The molar ratio of the copolymer of dibehenyl fumarate and vinyl acetate to the copolymer of ditallow fumarate and vinyl acetate may range between about 0.5:1 and about 1.5:1, preferably between about 0.9:1 and about 1.1:1. The weight ratio of asphaltene to the total weight of copolymers may range between about 0.5:1 and about 25:1.

The utility of the present invention can be seen from the small quantities of the relatively expensive copolymers utilized and the larger quantity of the relatively inexpensive asphaltenic material utilized.

Pour point depressants conventionally are sold as concentrates in solvent so that they easily can be added to the hydrocarbon oil which is to be treated to improve the low temperature flow properties. Typically, a diluent is added so that the additive is a single phase liquid. The pour point depressant of the present invention could be utilized as a concentrate having both copolymers, asphaltenes and a diluent. Alternatively, the presently described pour point depressant could be utilized with the concentrate containing only the two copolymers and the asphaltenic material added separately.

A preferred diluent is a heavy aromatic naphtha. The additive preferably is admixed with the hydrocarbon oil at a temperature substantially above the wax appearance point, since the solubility of the additive in the fuel will be higher at elevated temperature.

What is claimed is:

1. A pour depressant for addition to a hydrocarbon oil comprising:

A. an asphaltene;

B. a copolymer of:
I. dibehenyl fumarate; and,
II. vinyl acetate; and,
C. a copolymer of:
I. ditallow fumarate; and
II. vinyl acetate wherein the weight ratio of asphaltene to the total weight of copolymers ranges between about 0.5:1 and about 25:1, and the molar ratio of the copolymer of dibehenyl fumarate and vinyl acetate to the copolymer of ditallow fumarate and vinyl acetate ranges between about 0.5:1 and about 1.5:1.

2. The pour depressant of claim 1 wherein the molar ratio of dibehenyl fumarate to vinyl acetate ranges between about 0.5:1 and about 1.5:1.

3. The pour depressant of claim 1 wherein the molar ratio of ditallow fumarate to vinyl acetate ranges between about 0.5:1 and about 1.5:1.

4. The pour depressant of claim 1 wherein the asphaltenic compound is selected from the group consisting of lube deasphalting unit asphaltenes, tars, asphalts, and residuum vacuum bottoms.

5. A method for depressing the pour point of a hydrocarbon oil having a pour point above about 40° F. comprising admixing with the hydrocarbon oil an effective amount of a pour depressant comprising:
A. about 0.01 to about 2.0 wt% asphaltene containing material;
B. about 0.005 to about 0.5 wt% of a copolymer of dibehenyl fumarate and vinyl acetate; and,
C. about 0.005 to about 0.5 wt% of a copolymer of ditallow fumarate and vinyl acetate based upon the weight of hydrocarbon oil.

6. A method for providing a shale oil of improved storage stability and improved pour point comprising:
A. hydrotreating the shale oil; and,
B. adding to the shale oil a pour depressant comprising:
(1) about 0.01 to about 2.0 wt% of an asphaltenic containing material
(2) about 0.005 to about 0.5 wt% of a copolymer of dibehenyl fumarate and vinyl acetate; and,
(3) about 0.005 to about 0.5 wt% of a copolymer of ditallow fumarate and vinyl acetate based upon the weight of the shale oil.

7. The method of claim 6 wherein the pour depressant is added after the shale oil has been hydrotreated.

8. An oil having a reduced pour point comprising a hydrocarbon basestock and an additive comprising:
A. about 0.01 to about 2.0 wt% asphaltene;
B. about 0.005 to about 0.5 wt% of a copolymer of dibehenyl fumarate and vinyl acetate; and,
C. about 0.005 to about 0.5 wt% of a copolymer of ditallow fumarate and vinyl acetate, based upon the weight of the hydrocarbon oil.

* * * * *